US011639601B2

(12) United States Patent
Abbas et al.

(10) Patent No.: US 11,639,601 B2
(45) Date of Patent: May 2, 2023

(54) SYSTEM AND METHOD FOR CONNECTING A SQUARE CONCRETE-FILLED STEEL TUBULAR COLUMN TO A REINFORCED CONCRETE FOOTING

(71) Applicant: KING SAUD UNIVERSITY, Riyadh (SA)

(72) Inventors: Husain Abbas, Riyadh (SA); Nadeem A. Siddiqui, Riyadh (SA); Baha M. A. Khateeb, Riyadh (SA); Tarek H. Almusallam, Riyadh (SA); Yousef A. Al-Salloum, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 17/176,919

(22) Filed: Feb. 16, 2021

(65) Prior Publication Data

US 2022/0042297 A1 Feb. 10, 2022

Related U.S. Application Data

(62) Division of application No. 16/986,249, filed on Aug. 5, 2020, now Pat. No. 10,954,662.

(51) Int. Cl.
*E04B 1/24* (2006.01)
*E04B 1/30* (2006.01)
(Continued)

(52) U.S. Cl.
CPC ..... *E04B 1/2403* (2013.01); *E02D 27/42* (2013.01); *E04B 1/30* (2013.01); *E04C 3/32* (2013.01);
(Continued)

(58) Field of Classification Search
CPC ..... E02D 27/42; F03D 13/22; E04H 12/2269; E04H 12/22; E04H 17/22; E04B 1/2403;
(Continued)

(56) References Cited

U.S. PATENT DOCUMENTS 2,862,738 A * 12/1958 Bayley ..... E02B 17/06 403/349
3,231,229 A * 1/1966 Morella ..... E04H 13/003 248/158
(Continued)

FOREIGN PATENT DOCUMENTS

CN 203049798 U 7/2013
CN 203403542 U 1/2014
(Continued)

OTHER PUBLICATIONS

Hitaka et al., "CFT Column Base Design and Practice in Japan", Proceedings of the International Workshop on Steel and Concrete Composite Construction (2003), National Center for Research in Earthquake Engineering, Taipei, Taiwan, 10 pages.
(Continued)

*Primary Examiner* — Brent W Herring
(74) *Attorney, Agent, or Firm* — Nath, Goldberg & Meyer; Richard C. Litman

(57) ABSTRACT

The system and method for connecting a square concrete-filled steel tubular column to a reinforced concrete footing includes a short steel pipe partially embedded in the footing, the pipe having a top end having flanges extending radially therefrom, the top end extending into a cavity in the footing having an elliptical top opening and circular base, the flanges extending above the base. An elliptical base plate is welded to the bottom of the tubular steel column, the base plate having a circular opening defined therein and a plurality of spaced flange slots depending therefrom. The bottom end of the column is lowered into the cavity, the
(Continued)

elliptical base plate passing through the elliptical opening in the cavity, and the column is rotated 90° to interlock the flanges with the flange slots. The cavity is filled with concrete grout, and the square or rectangular steel column is filled with concrete.

4 Claims, 10 Drawing Sheets

(51) Int. Cl.

| | |
|---|---|
| ***E04C 3/34*** | (2006.01) |
| ***E04G 21/14*** | (2006.01) |
| ***E04C 3/32*** | (2006.01) |
| ***E02D 27/42*** | (2006.01) |
| ***E04H 12/22*** | (2006.01) |

(52) U.S. Cl.
CPC ..... *E04C 3/34* (2013.01); *E04G 21/14* (2013.01); *E04H 12/2269* (2013.01); *E04B 2001/2463* (2013.01); *E04B 2001/2478* (2013.01)

(58) Field of Classification Search
CPC ..... E04B 1/30; E04B 2001/2463; E04B 2001/2478; E04C 3/32; E04C 3/34; E04G 21/14
USPC ..... 52/848, 704, 709, 711, 649.3, 649.2, 52/649.6, 296, 297, 298
See application file for complete search history.

(56) References Cited

U.S. PATENT DOCUMENTS

| | | | | |
|---|---|---|---|---|
| 3,434,261 | A * | 3/1969 | Rohe | F16B 5/01 52/787.12 |
| 3,579,936 | A * | 5/1971 | Andersson | E04H 12/2284 52/297 |
| 3,913,953 | A | 10/1975 | Archer et al. | |
| 4,223,861 | A * | 9/1980 | Guggemos | F16M 11/105 248/222.52 |
| 5,037,093 | A * | 8/1991 | Roark, Jr. | A63B 63/083 473/483 |
| 5,505,033 | A | 4/1996 | Matsuo et al. | |
| 5,826,387 | A | 10/1998 | Henderson et al. | |
| 6,098,361 | A * | 8/2000 | Roten | E04H 12/2269 403/277 |
| 7,003,919 | B2 * | 2/2006 | Riker | E04H 12/2269 52/170 |
| 7,055,807 | B2 * | 6/2006 | Pesta | E04H 12/2269 160/351 |
| 7,637,076 | B2 | 12/2009 | Vaughn | |
| 7,877,944 | B2 * | 2/2011 | Seidel | E02D 27/42 52/296 |
| 7,954,289 | B2 * | 6/2011 | Evans | E01F 9/685 52/298 |
| 8,966,837 | B2 * | 3/2015 | Knudsen | E02D 5/26 52/165 |
| 10,563,402 | B1 | 2/2020 | Abbas et al. | |
| 2007/0166111 | A1 | 7/2007 | Knepp et al. | |
| 2009/0320396 | A1 * | 12/2009 | Knudsen | E04F 19/00 52/297 |
| 2011/0005078 | A1 * | 1/2011 | Marshall | E02D 27/01 29/897.3 |
| 2011/0023384 | A1 * | 2/2011 | Marshall | E04B 1/3511 52/125.1 |

FOREIGN PATENT DOCUMENTS

| | | | | |
|---|---|---|---|---|
| DE | 202015100932 | U1 * | 6/2015 | F03D 13/22 |
| JP | 9-256382 | A | 9/1997 | |
| WO | WO-2019172051 | A1 * | 9/2019 | E02D 27/00 |

OTHER PUBLICATIONS

Lehman et al., "Foundation connections for circular concrete-filled tubes", Journal of Constructional Steel Research (2012), vol. 78, pp. 212-225 (Abstract only).
Roeder et al., "Concrete Filled Steel Tubes for Bridge Pier and Foundation Construction", International Journal of Steel Structures (2018), vol. 18, pp. 39-49 (Abstract only).
Any identified foreign patents and/or publications were properly filed in parent U.S. Appl. No. 16/986,249, filed Aug. 5, 2020, the priority of which is claimed.

* cited by examiner

SYSTEM AND METHOD FOR CONNECTING A SQUARE CONCRETE-FILLED STEEL TUBULAR COLUMN TO A REINFORCED CONCRETE FOOTING

CROSS REFERENCE TO RELATED APPLICATIONS

This application is a division of parent application Ser. No. 16/986,249, filed Aug. 5, 2020, pending, the priority of which is claimed.

BACKGROUND

1. Field

The disclosure of the present patent application relates to construction of buildings, bridges, and similar structures having columns of tubular steel filled with concrete, and particularly to a system and method for connecting a square concrete-filled steel tubular column to a reinforced concrete footing.

2. Description of the Related Art

There is an increasing trend in using concrete-filled steel tubular (CFST) columns in recent decades, such as in industrial and high-rise buildings, structural frames, and bridges. CFST columns promote economical and rapid construction. They offer increased strength and stiffness relative to structural steel and reinforced concrete columns. The steel tubes serve as a formwork and reinforcement for the concrete fill, thereby reducing the labor requirements. CFST columns encourage the optimal use of the two materials (concrete and steel), while providing a symbiotic relationship between the two to mitigate undesirable failure modes. The concrete fill increases the compressive strength and stiffness, delays and restrains local buckling of the steel tube, and enhances ductility and resistance. Both rectangular and circular CFSTs have been employed. A missing component for CFST construction is the reliable and ductile column-to-foundation connections under seismic or cyclic lateral loading.

Recently, the present inventors have developed an efficient CFST column-to-foundation connection for circular columns. See U.S. Pat. No. 10,563,402, issued Feb. 18, 2020. However, there is no efficient and effective connection available for the rectangular/square columns. There is a need for such CFST column-to-foundation connection for rectangular/square columns that can transfer combined bending and axial loads and have sufficient deformability to sustain multiple inelastic deformation cycles under extreme seismic loading.

Thus, a system and method for connecting a square concrete-filled steel tubular column to a reinforced concrete footing solving the aforementioned problems is desired.

SUMMARY

The system and method for connecting a square concrete-filled steel tubular column to a reinforced concrete footing begins with forming a cavity in the reinforced concrete footing, the cavity having an elliptical opening at the top of the footing and a circular base. A short steel pipe is partially embedded in the footing, the pipe having a top end and a bottom end. At least two flanges extend radially from the top and bottom ends of the pipe, the bottom end being embedded in the footing and the top end extending through the base of the cavity so that the flanges extend above the base of the cavity. An elliptical base plate is welded to the bottom of the tubular steel column, the base plate having a circular opening defined therein and a plurality of spaced flange slots depending therefrom. The bottom end of the column is lowered into the cavity, the elliptical base plate passing through the elliptical opening in the cavity, and the column is rotated 90° to interlock the flanges with the flange slots. The cavity is filled with concrete grout, and the square or rectangular steel tubular column is filled with concrete.

The column-footing connection formed in this manner provides improved connection between square CFST columns and RC footings for carrying gravity and lateral loads. It also minimizes the fabrication work after first-stage concreting of RC footing and controls the story drift in high-rise buildings in which CFST columns are becoming more popular. The system and method enhance the connection response and construction ease while maintaining the benefits of precast construction.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The system and method for connecting a square concrete-filled steel tubular column to a reinforced concrete footing begins with forming a cavity in the reinforced concrete footing, the cavity having an elliptical opening at the top of the footing and a circular base. A short steel pipe is partially embedded in the footing, the pipe having a top end and a bottom end. At least two flanges extend radially from the top and bottom ends of the pipe, the bottom end being embedded in the footing and the top end extending through the base of the cavity so that the flanges extend above the base of the cavity. An elliptical base plate is welded to the bottom of the tubular steel column, the base plate having a circular opening defined therein and a plurality of spaced flange slots depending therefrom. The bottom end of the column is lowered into the cavity, the elliptical base plate passing through the elliptical opening in the cavity, and the column is rotated 90° to interlock the flanges with the flange slots. The cavity is filled with concrete grout, and the square or rectangular steel column is filled with concrete.

Figure 1:
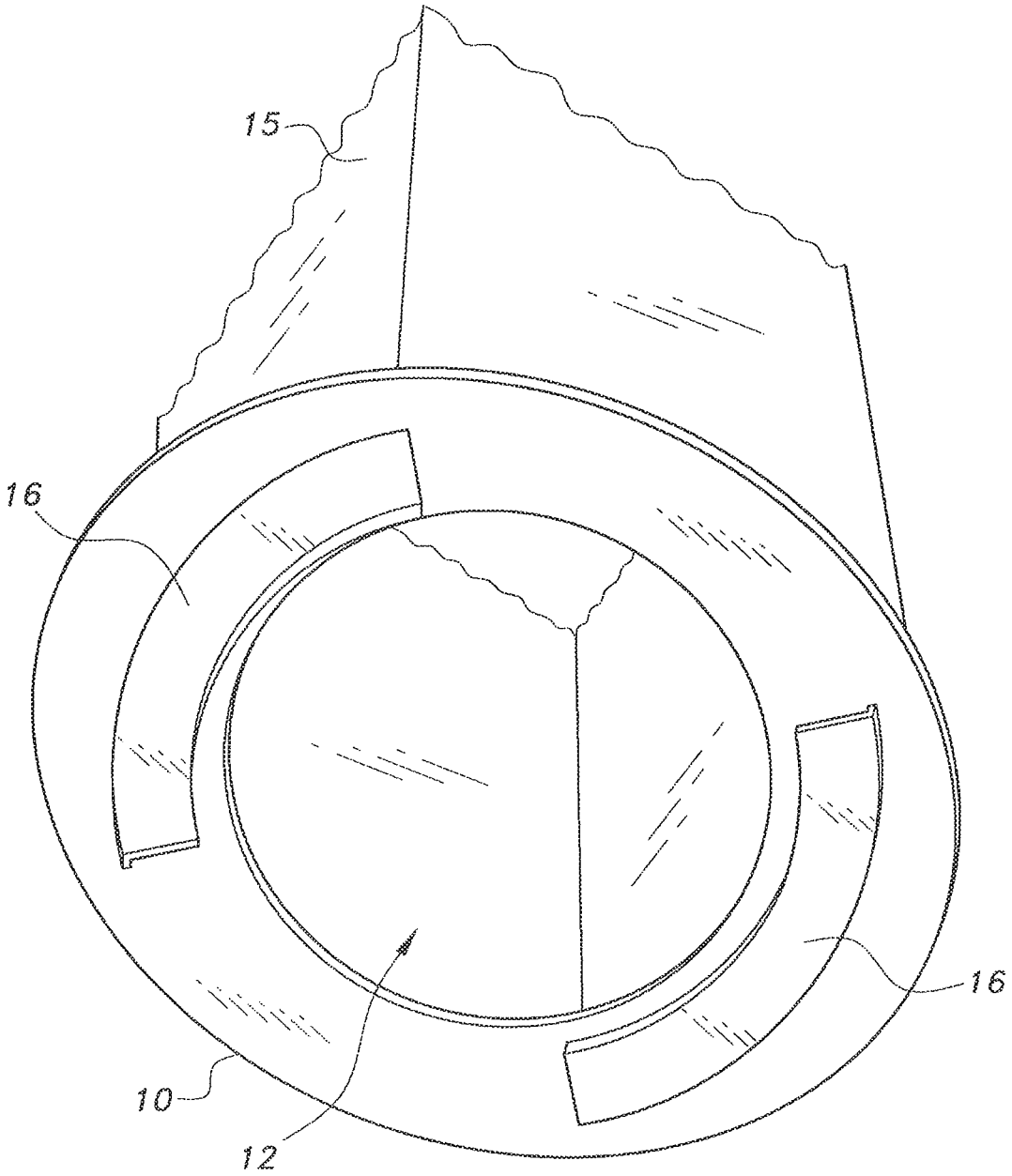
FIG. 1 is a perspective view of a square steel tubular column with attached base plate as seen from below in a system and method for connecting a square concrete-filled steel tubular column to a reinforced concrete footing.
Figure 2:
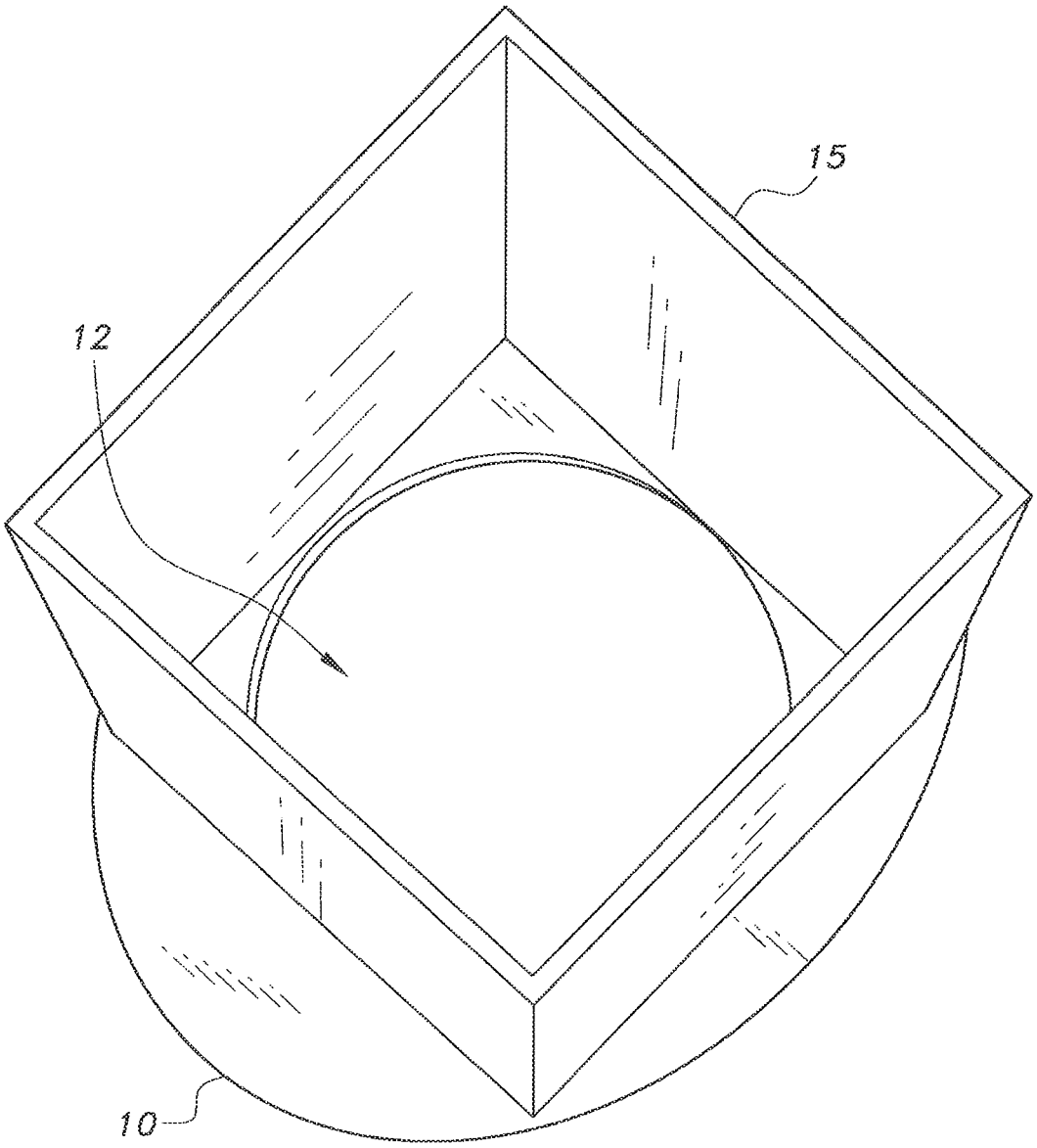
FIG. 2 is a perspective view of the square steel tubular column with attached base plate of FIG. 1 as seen from above in a system and method for connecting a square concrete-filled steel tubular column to a reinforced concrete footing.
Figure 3:
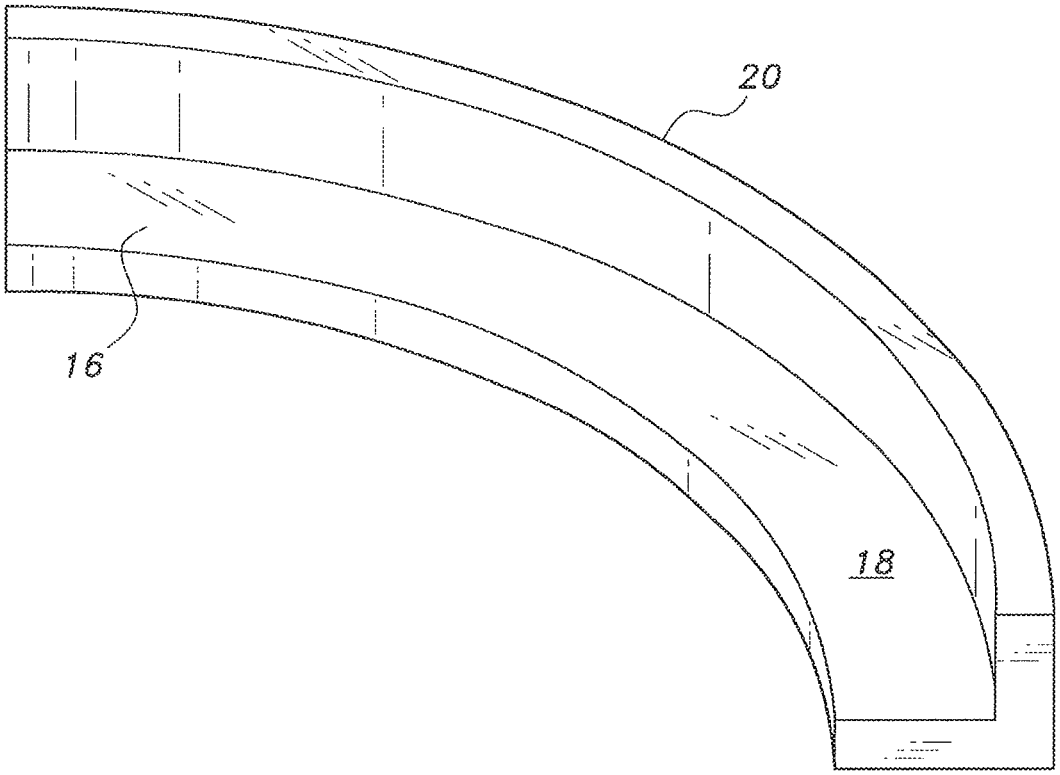
FIG. 3 is a perspective view of a flange slot shown before attachment to the base plate of FIG. 1.
Figure 4:
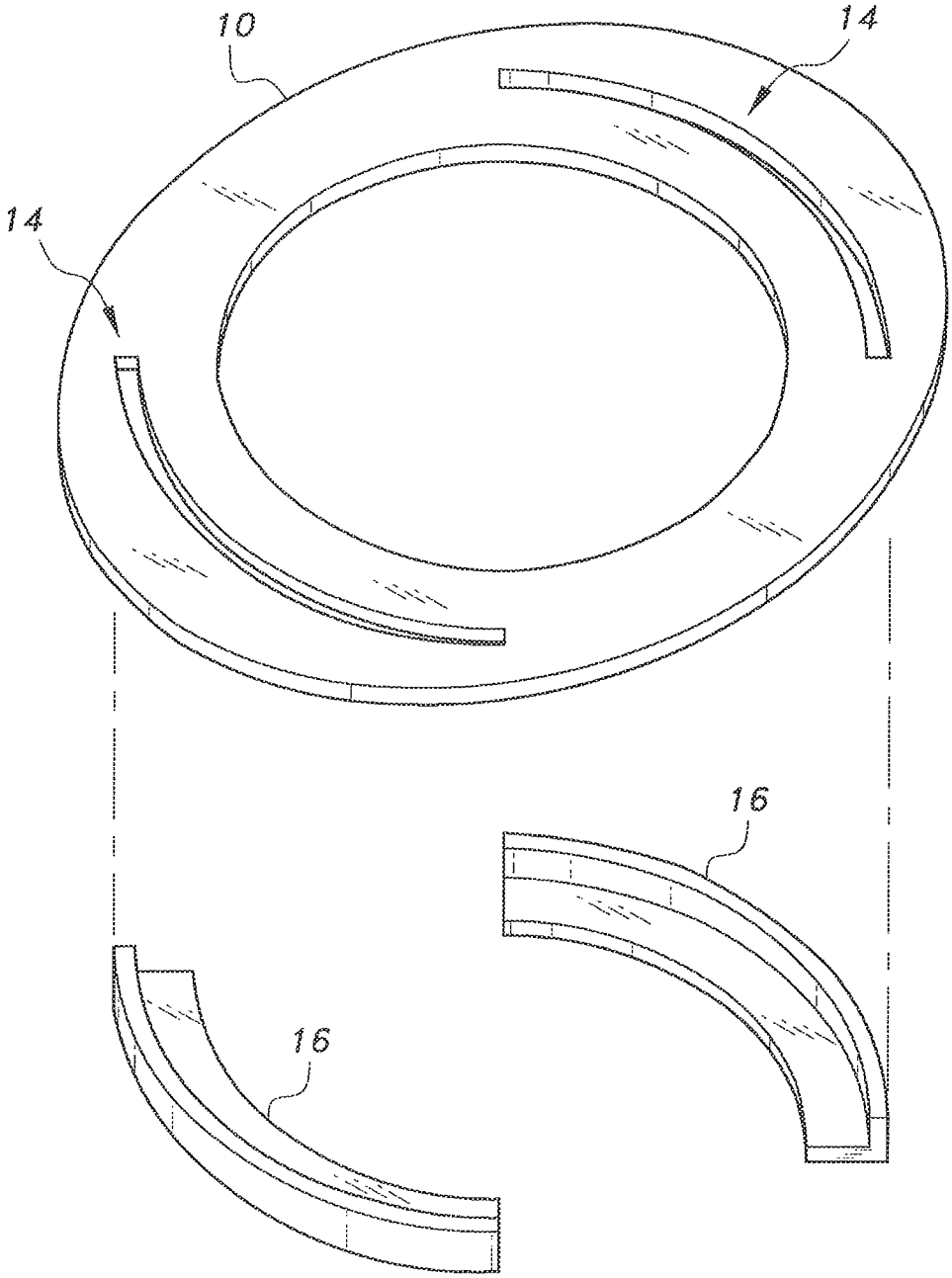
FIG. 4 is an exploded perspective view of the flange slots and base plate of FIG. 1.
Figure 5:
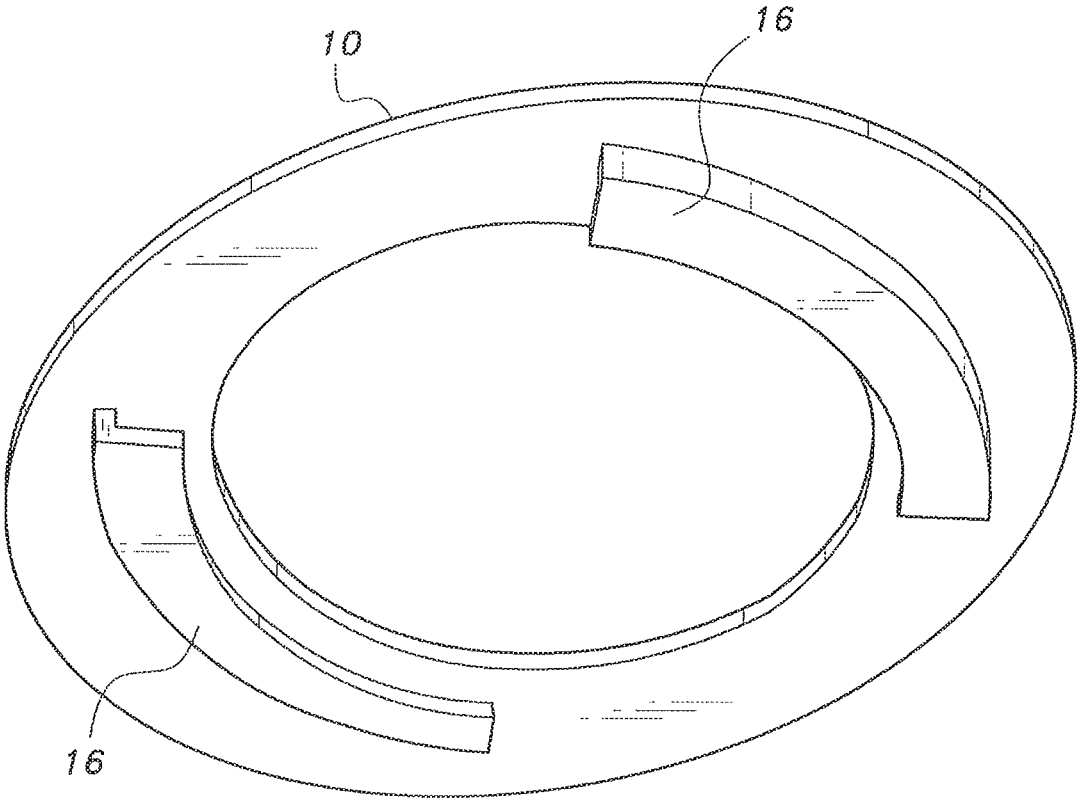
FIG. 5 is a perspective view of the assembled base plate of FIG. 1 as seen from below, shown before attachment to the bottom of the steel tubular column.

As shown in FIGS. 1-5, an elliptical base plate 10 with a central circular (or square) hole 12 is prepared for attachment to the base of the square steel tubular column 15. The minor diameter of the base plate 10 is slightly greater than the outer size of the concrete-filled steel tubular (CFST) column 15 and the major diameter is 10% to 40% larger than the minor diameter. The diameter of the circular hole 12 in the base plate 10 is less than or equal to the size of the square column 15 (the size of the hole 12 shown in FIG. 2 is equal to the size (i.e., the width of one side) of the square column 15). By keeping the diameter of the circular hole 12 smaller than the size of the square column 15, the size of the base plate 10 can be reduced. This also helps in welding the base plate 10 properly to the inner face of the steel tubular column 15. However, the size of the circular hole should not be less than that required for easy access for welding of the base plate 10 (to the inner face of the steel tubular column 15). Also, the system and method can be used for circular CFST columns, in which the diameter of the hole in the elliptical base plate can be less than the diameter of steel pipe of column. Two quadrant slots 14 are cut (these may be in the form of several small size slots at regular spacing, which will require corresponding teeth in the form of vertical circular segmental plate of the flange slots) in the base plate 10, as shown in FIG. 4, for accommodating the arcuate angles forming the flange slots 16 (female). The flange slots 16 are prepared by welding horizontal quadrant arcuate plate 18 with vertical circular segmental plate 20, as shown in FIG. 3, i.e., the slots 16 are arcuate angles having a vertical flange 20 and a horizontal flange 18 defining the slots 16. The flange slots 16 are fixed in the cut slots 14 of the base plate 10 and welded to form flange slots 16 depending from or extending below the base plate 10, as shown in FIGS. 4 and 5. This method of welding is adopted for avoiding difficulty in welding the inner edges of flange slots to the base plate without cut slots. This base plate assembly is then welded to the column base. Although FIGS. 1-5 show two diametrically opposed 90° flange slots 16, it will be understood that in some embodiments, the base plate 10 may have more than two flanges slots 16.

Figure 6:
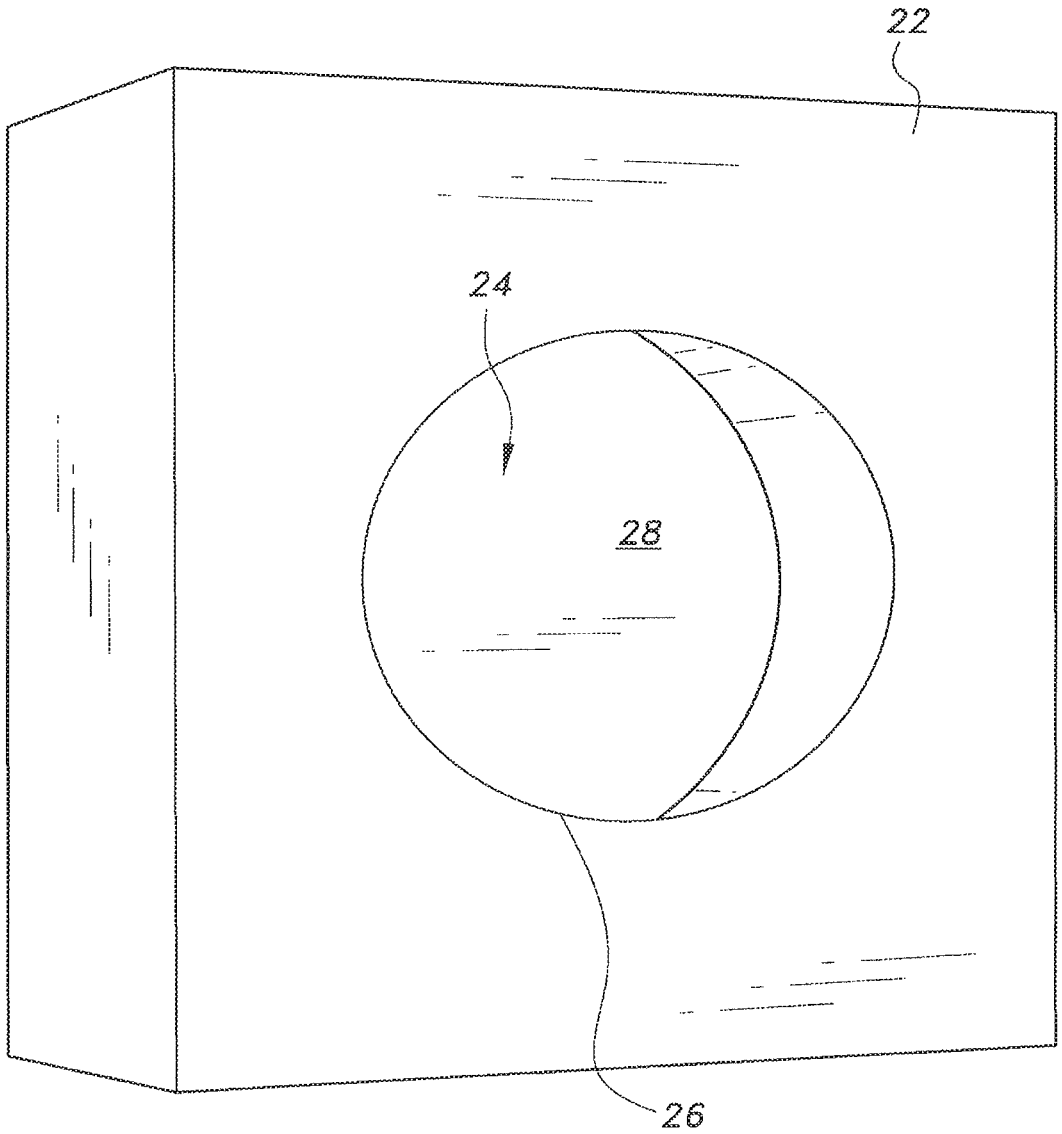
FIG. 6 is a perspective view of a cavity formed in a reinforced concrete footing in a system and method for connecting a square concrete-filled steel tubular column to a reinforced concrete footing.
Figure 7:
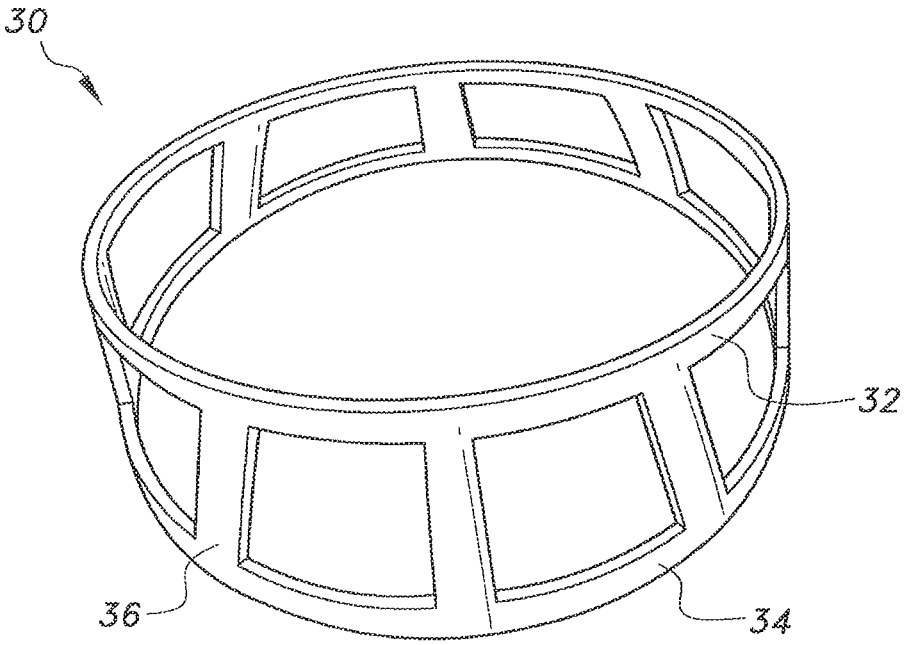
FIG. 7 is a steel form used to make the cavity of FIG. 6.
Figure 8:
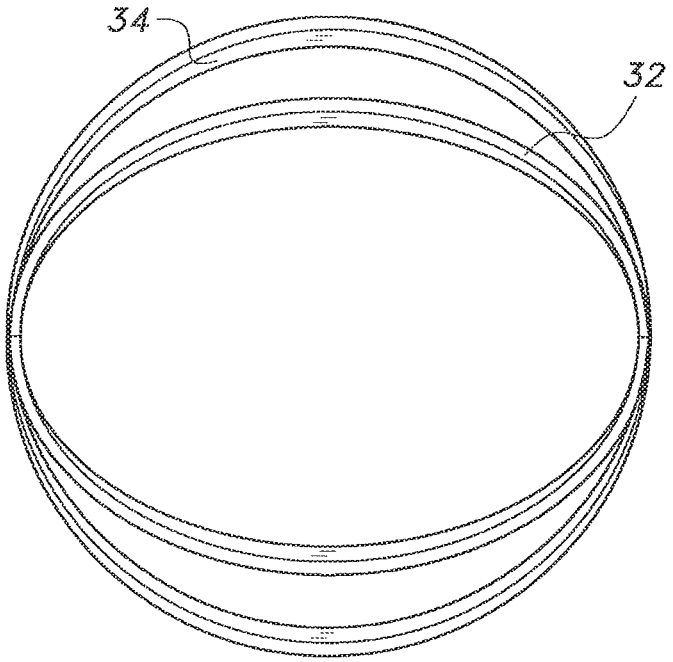
FIG. 8 is a top view of the elliptical and circular rings used in the steel form of FIG. 7 to make the cavity of FIG. 6.

As shown in FIGS. 6-8, during the casting of the reinforced concrete (RC) footing 22, a cavity 24 is created for accommodating the CFST column base. The shape of the cavity 24 is such that it transforms from an elliptical shape in plan at the top 26 of the RC footing 22 to a circular shape at the base 28 of the cavity 24, as shown in FIG. 6. The diameter of the base 28 of the cavity 24 is equal to the major diameter of the elliptical opening. The major axis of the elliptical cavity is aligned with the axis of maximum column moment. The rebars on the cavity surface should be in the shape of the cavity 24, which can be easily achieved by leaving a uniform clear cover on the surface of the cavity 24. The cavity 24 is formed by using a demountable cavity form 30, shown in FIG. 7. The cavity form 30 is fabricated using an upper elliptical ring 32 and a bottom circular ring 34, shown in FIG. 8, which are connected through slanting steel strips 36 with the help of screws or other fasteners, as shown in FIG. 7. The two rings 32, 34 and the strips 36 have screw holes at regular intervals, which are used for connecting wooden battens (not shown in FIGS. 7 and 8) for closing the openings. The smooth transition from elliptical at the top 26 to circular at the base 28 of the cavity 24 is not required. The shape of the cavity 24 at the top 26 and the base 28, however, is significant. For demounting the form 30, the wooden battens can be easily removed by unscrewing the screws. The steel cage can either be left in place or extracted by unscrewing the screws connecting the strips 36. In case the steel cage is be extracted, it should be lubricated or covered with plastic sheet before concreting. The bottom circular steel ring 34 can either be left in place, or if this is to be extracted, it should be fabricated by screwing two or more semicircular segments together.

Figure 9:
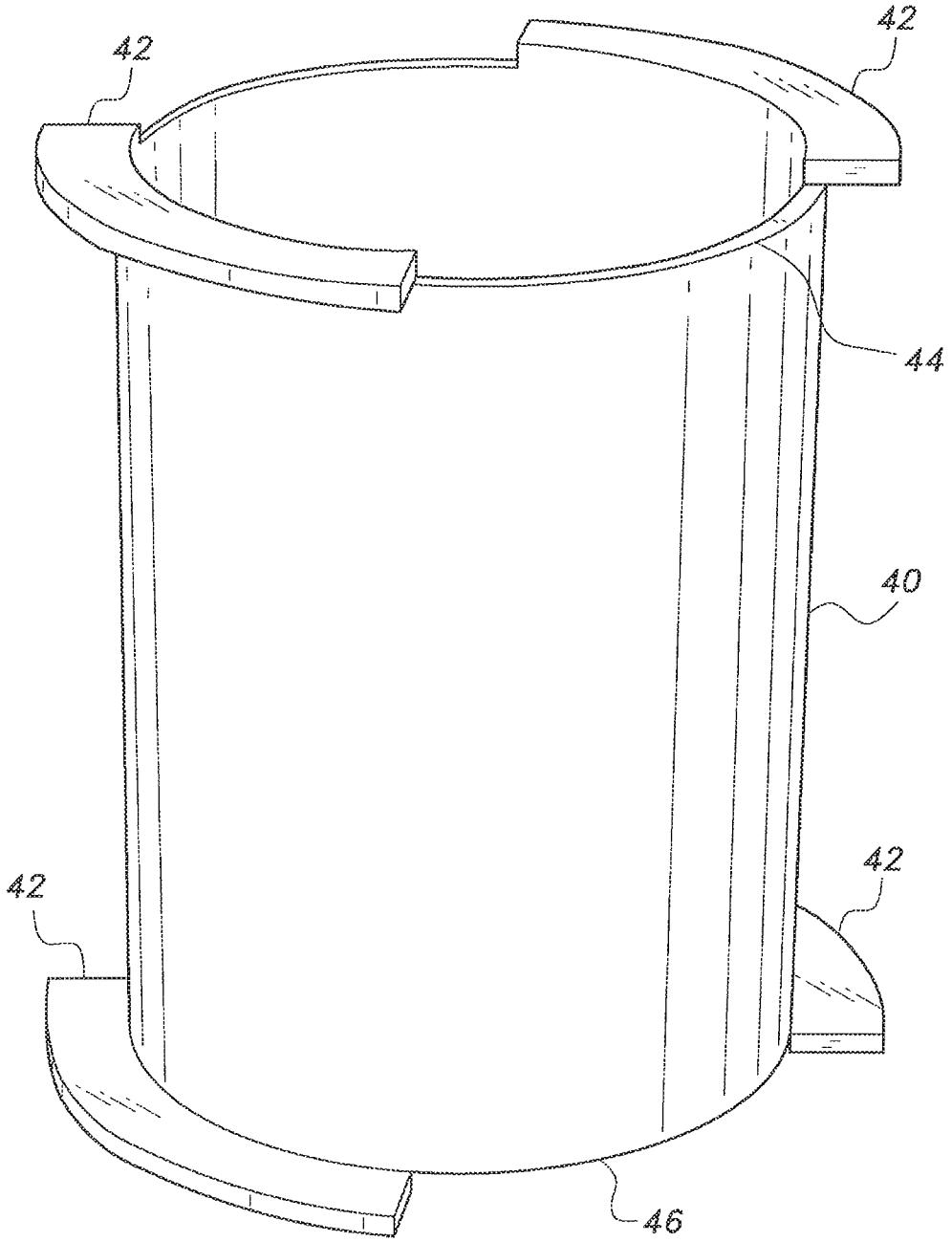
FIG. 9 is a perspective view of a short steel pipe that will be partially embedded in the footing of FIG. 6.
Figure 10A:
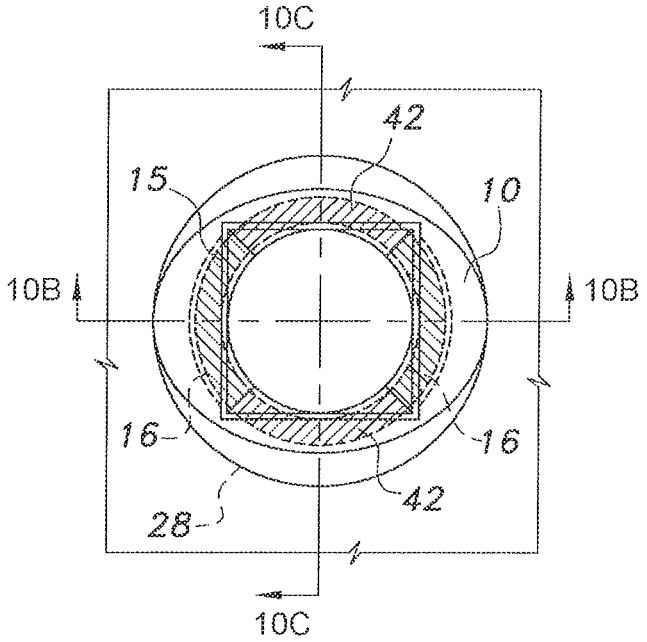
FIG. 10A is a diagrammatic top view of a square steel tubular column after initial placement in the footing cavity of FIG. 6 and embedding the steel pipe of FIG. 9, but before rotation of the column.
Figure 10C:
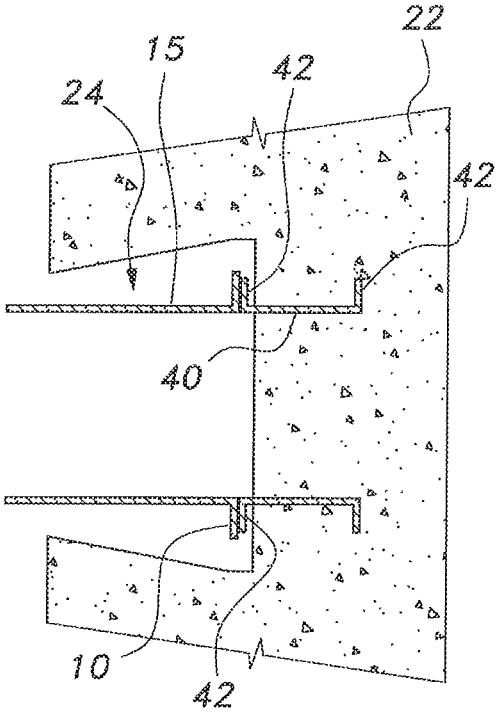
FIG. 10C is a section view drawn along lines 10C-10C of FIG. 10A.
Figure 10B:
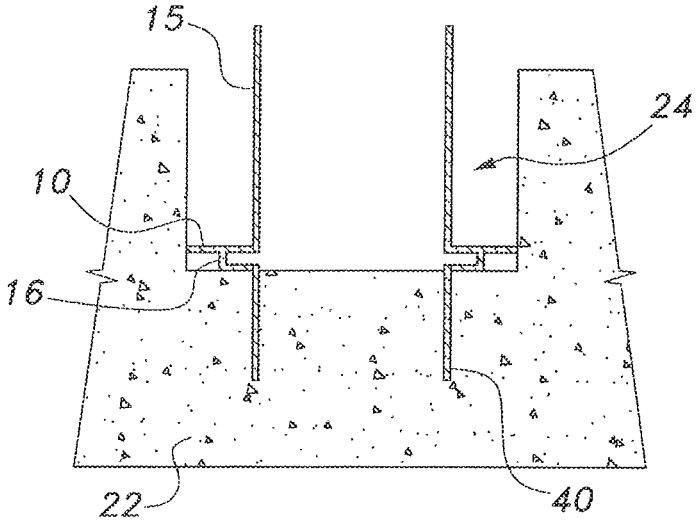
FIG. 10B is a section view drawn along lines 10B-10B of FIG. 10A.
Figure 11A:
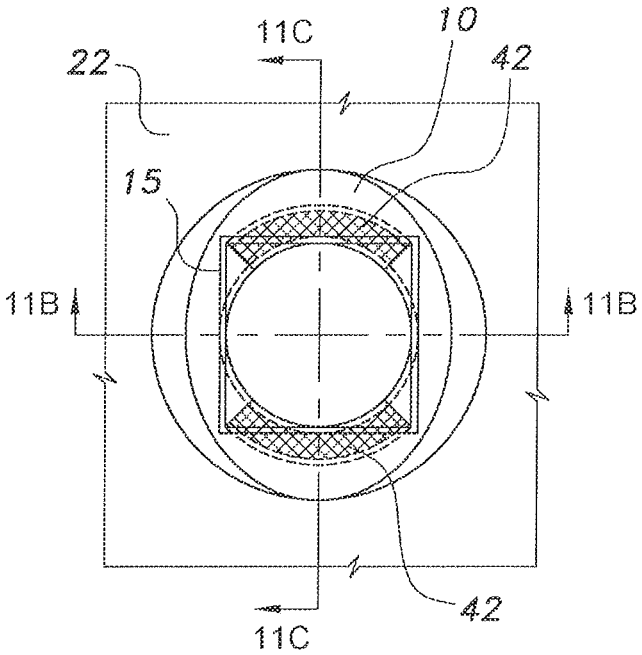
FIG. 11A is a diagrammatic top view of a square steel tubular column after initial placement in the footing cavity of FIG. 6 and embedding the steel pipe of FIG. 9, and after 90° rotation of the column to interlock the flanges with the flange slots.
Figure 11C:
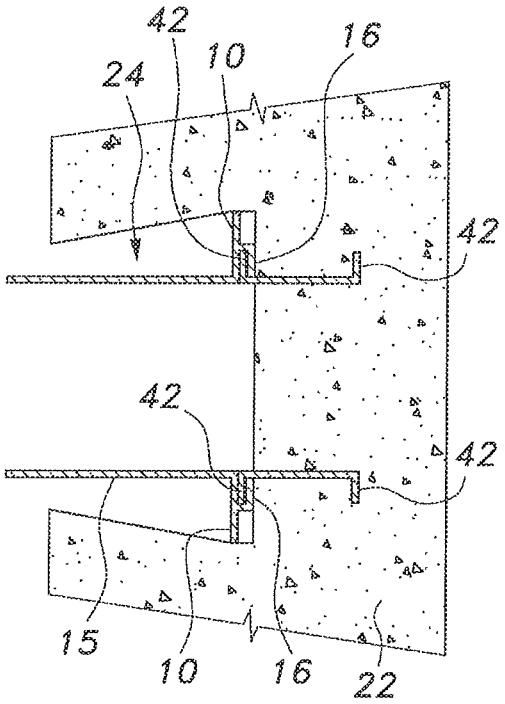
FIG. 11C is a section view drawn along lines 11C-11C of FIG. 11A.
Figure 11B:
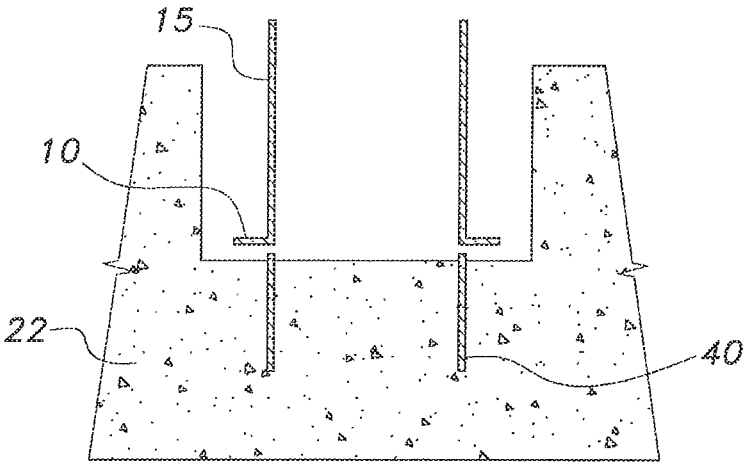
FIG. 11B is a section view drawn along lines 11B-11B of FIG. 11A.

The depth of the cavity 24 in the RC footing 22 may vary from 20% to 100% of the outer size of the square CFST column 15, depending upon the connection design. As shown in FIG. 9, a small length of the steel pipe 40 with two opposite flanges 42 (or collars) welded at its top 44 as well as at the bottom 46 of the pipe 40 at vertically the same alignment is partially embedded in the RC footing 22, as shown in FIGS. 10A-11C. The top flanges 42 can be welded on the top edge 44 of the pipe 40 (as shown in FIG. 9) or on the outside face of the pipe 40 and flush with the top edge 44 of the pipe 40. The flanges 42 may be diametrically opposite each other and extend radially outward from the pipe 40 in a 90° arc. The welding on the outside face of the pipe 40 will make the top edge 44 of the pipe assembly flat, thus making the column base plate 10 to rest on it without any gap between the two, as seen in FIG. 11B. The use of flanges 42 at the bottom 46 of the pipe 40 helps in improving the anchorage of the steel pipe 40 in the concrete footing 22, and hence reducing the length of the pipe 40, which is desired when sufficient depth is not available for accommodating the pipe 40 in the concrete footing 22. The bottom flanges 42 will also help in keeping the small embedded steel tube 40 in position before the first-stage concreting of the RC footing 22. Other means of better anchoring of the small embedded steel pipe 40 may alternatively or additionally be adopted. These may include the use of shear studs welded to the inner/outer or both surfaces of the embedded steel pipe or making perforations in the embedded length of the steel pipe. The height of the pipe 40 projecting through the base 28 into the cavity 24 is such that there is a gap equal to the thickness of steel plate under the upper flanges 42. The width of all flanges 42 is the same and may vary from 10% to 25% of the outer size of the steel tube, but not less than the thickness of pipe. Each flange 42 subtends an angle of 90° at the center (axis of column). These flanges 42 are located symmetrically opposite to the major axis of the elliptical cavity opening, as shown in FIGS. 10A-11C. The outer diameter of the flanges 42 is equal to the minor diameter of the ellipse at the top 26 of the cavity 24 minus the thickness of the steel plates used for making the flanges 42. The longitudinal axis of the small pipe 40 embedded in the first-stage concreting of the RC footing 22 is aligned with the longitudinal axis of the square CFST column 15. The length of this small embedded steel pipe 40 is such that it can be accommodated in the RC footing 22 under the cavity 24.

After hardening of the first-stage concrete of the RC footing 22, the square steel tubular column 15 with welded base plate 10 assembly is lowered into the cavity 24 of the RC footing 22. The shape of both the top 26 of the cavity 24 as well as the base plate 10 of the column 15 being elliptical, the column 15 will be required to be aligned so that the elliptical base plate 10 of the steel column 15 may be lowered vertically into the cavity 24. After the initial lowering of the column 15 to the base 28 of the cavity 24 (shown in FIGS. 10A-10C), the steel tubular column 15 is rotated by 90°, thereby making an interlock between the flanges 42 of the steel pipe 40 embedded in the first-stage concrete of the RC footing 22 and the corresponding flange slots 16 at the column base 10, as shown in FIGS. 11A-11C. The thickness of the flanges 42 (male) and matching slots 16 (female) should be equal to or greater than the thickness of the steel tube of the CFST column 15.

The foundation cavity 24 is then filled with second-stage non-shrinkable cement grout. After the hardening of the second-stage cement grout, concreting is done in the steel tubular column 15, thereby converting it to the CFST column.

Enough clearances are to be maintained between the coupling members for their free movement. However, these should not be very loose to avoid large slackness.

The circular opening 12 in the base plate 10 may be square and of the same size as the inner size of the tubular column 15 or smaller. The smaller size of the opening, and hence the smaller major diameter of the base plate 10, will not only reduce the foundation cavity size, but also reduce the bending moment in the overhang portion of the base plate 10 due to the reduction in the overhang.

The bending of the column under the action of lateral loads on the column tries to pull the square CFST column out of the cavity. The proposed connection resists this pull out and hence provides moment resisting capacity to the column base by the following mechanisms.

In a first mechanism, mechanical interlock between the mating steel flanges of the small embedded steel pipe (male) and the flange slots (female) welded underneath the elliptical base plate of the steel tubular column resists the column moments. This contributes significantly in resisting the column moments.

In a second mechanism, even after failure of the mechanical interlock or severe deformation in the interlocking flanges, the elliptical column base plate (which is now embedded in cement grout) cannot come out because the second-stage grout need to be pushed upward, which will be resisted by the negatively sloping interface between the first-stage concrete of the RC footing and the second-stage cement grout. This is because the width of the second-stage grout at the top of the RC footing is equal to the minor diameter of the ellipse.

The system and method described above is susceptible to variation in several respects. In a first variation, the elliptical shape of the cavity in the first-stage concrete of the RC footing and the column base plate may be replaced by rectangular shapes with rounded corners. The diameter of the base of the first-stage concrete of the RC footing would be equal to the length of the rectangle.

In a second variation, the use of two flanges subtending an angle of 90° is most efficient for resisting column moment (or bending) about the major axis of elliptical cavity. However, for resisting column moment in two transverse directions (biaxial bending), the number of flanges (or collars), n, welded to the small steel pipe embedded in the first stage of concrete of the RC footing and the corresponding n flange slots (female) welded to the elliptical base plate of the steel column may be more than two (preferably four or more, depending on the circumferential length of the flanges, as per design). The angle subtended by these flanges would then be 360/(2n) degrees. The use of more than two flanges reduces rotation of the column for achieving mechanical interlock, which will be 360/(2n) degrees. However, for aligning the major axis of the base plate 10 with the minor axis of the elliptical opening 26, the column is rotated by 90°. In this position, the connection offers maximum moment of resistance along the major axis of the elliptical cavity.

In a third variation, reliance may be placed substantially on the use of mechanical interlock alone, wherein the shape of the cavity in the first-stage concrete is cylindrical. Thus, the column base plate may also be circular instead of elliptical. This simplifies the construction of the cavity in the first-stage concrete of the RC footing. The column moments (bending) in this type of connection is resisted by mechanical interlock and the resistance offered by a cylindrical interface between the first-stage concrete of the RC footing and the cement grout.

In a fourth variation, the connection may be made without mechanical interlock, which is same as described, above but without any mechanical interlocking flanges. Thus, there is no requirement of embedding a small steel pipe in the first-stage concrete of the RC footing, and no requirement of flange slots welded to the base plate of the steel tubular column. The surface of the cylindrical cavity can be made corrugated for providing additional moment of resistance.

The selection of the type of connection will be based on the moment-resisting requirements, ease of construction, etc.

Finally, the proposed connection can be easily extended to rectangular and polygonal CFST column-to-foundation connections.

The proposed connection is expected to avoid failure of the square CFST column bases. The enhancement in the moment-resisting capacity of the connection reduces the story drift when the proposed connection is adopted in the CFST columns of high-rise buildings. When these columns are used in bridges, the proposed connection helps in reducing vibrations, and keeps the lateral bridge movements in check.

It is to be understood that the system and method for connecting a square concrete-filled steel tubular column to a reinforced concrete footing is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A method for connecting a concrete-filled square steel tubular column to a reinforced concrete footing, comprising the steps of:

preparing a reinforced concrete footing having a top surface and a cavity defined in the footing, the cavity defining an elliptical opening in the top surface of the footing and having a base opposite the elliptical opening, wherein the base of the cavity in the reinforced concrete footing is circular, the cavity having at least one wall tapering outward from the elliptical opening in the top surface of the footing to the circular base of the cavity;

embedding a bottom end of a steel pipe in the footing, the steel pipe having a top end extending through the base into the cavity and a plurality of flanges extending radially from the top end;

attaching an elliptical base plate to a bottom end of a square steel tubular column, the base plate having a central opening defined therein and a plurality of flange slots depending therefrom;

lowering the bottom end of the column and the elliptical base plate through the elliptical opening into the cavity defined in the footing;

rotating the column to interlock the flanges at the top end of the steel pipe with the flange slots of the base plate;

pouring concrete grout into the cavity and allowing the grout to harden to further secure the column to the footing; and pouring concrete into the square steel tubular column and allowing the concrete to harden.

2. The method for connecting a concrete-filled square steel tubular column to a reinforced concrete footing according to claim 1, wherein said step of preparing a reinforced concrete footing further comprises the steps of:

placing a form having an elliptical steel top ring, a circular steel bottom ring, a plurality of spaced apart steel slats sloping downward between the top ring and the bottom ring, and a plurality of temporary wooden battens disposed in the spaces between the slats in the footing to form the cavity; and removing at least the wooden battens from the footing after forming the cavity.

3. The method for connecting a concrete-filled square steel tubular column to a reinforced concrete footing according to claim 1, wherein said plurality of flange slots consists of two 90° arcuate flange slots and said plurality of flanges consist of two 90° arcuate flanges, said step of lowering the bottom end of the column further comprising lowering the column until the flange slots are positioned between the flanges and said step of rotating the column further comprises rotating the column 90° to interlock the flanges at the top end of the steel pipe with the flange slots of the base plate.

4. The method for connecting a concrete-filled square steel tubular column to a reinforced concrete footing according to claim 1, wherein said step of attaching an elliptical base plate further comprises welding the base plate to the bottom end of the column.

* * * * *